United States Patent [19]

Weiss

[11] 4,032,014

[45] June 28, 1977

[54] DISPLAY EASEL

[75] Inventor: Donald P. Weiss, Kinnelon, N.J.

[73] Assignee: Advertising Displays Corporation, Englewood Cliffs, N.J.

[22] Filed: Jan. 30, 1976

[21] Appl. No.: 653,663

[52] U.S. Cl. ..... 211/49 R; 248/450

[51] Int. Cl.[2] ..... A47F 7/00

[58] Field of Search ..... 248/450; 211/49 S, 55, 211/74

[56] References Cited

UNITED STATES PATENTS

| | | | |
|---|---|---|---|
| 1,204,920 | 11/1916 | Williamson | 248/450 X |
| 1,359,617 | 11/1920 | Nielsen | 248/450 |
| 1,915,496 | 6/1933 | Johnson | 211/74 |
| 2,338,969 | 1/1944 | Robinson et al. | 211/74 |
| 2,851,237 | 9/1958 | Welshenbach | 248/450 X |
| 3,300,055 | 1/1967 | Rohr | 211/74 |
| 3,746,178 | 7/1973 | Wagschal | 211/74 |
| D131,007 | 1/1942 | Carlson | 211/74 UX |

FOREIGN PATENTS OR APPLICATIONS

| | | | |
|---|---|---|---|
| 670,136 | 4/1952 | United Kingdom | 211/74 |

*Primary Examiner*—William H. Schultz

[57] ABSTRACT

This invention relates to an advertising display easel. The easel comprises in combination a back panel, means for supporting said back panel and pairs of opposing brackets extending from said back panel, said bracket, comprising a base and a side wall opposing the side wall of said opposing bracket allowing the display of small packages and articles.

1 Claim, 3 Drawing Figures

DISPLAY EASEL

BRIEF DESCRIPTION

This invention relates to an advertising display easel or rock. The easel or rock comprises in combination a back panel which may be provided with openings, means for suppporting said back panel, and pairs of opposing brackets extending from said back panel, said brackets comprising a base and a side wall opposing the side wall of the opposing bracket whereby said elements combine to support and display materials. The side wall for one bracket can combine to be the opposing side wall for a different pair of brackets. The brackets can be detachable and the means of support collapsible to allow the easel to be flat for storage and shipping.

Reference is had to prior art U.S. Pat. No. 2,110,429; 604,190; 1,515,741; and 1,189,531. There is shown therein several display easels. However, each of the prior art devices does not have the advantages of the present invention. The devices shown in the prior art are boxes which do not allow for the easy handling of the articles to be shown or are racks which allow the insertion of only one article to be displayed. The present invention allows for numerous articles to be displayed and allows for the piling of one article on top of another with the easy handling of each article.

It is the object of this invention to provide for an advertising display easel for the display of articles.

It is a further object of this invention to provide for an advertising display easel which is readily collapsible for easy storage and shipping.

It is a further object of this invention to provide for an advertising display easel which allows for the easy handling and display of many articles.

How the foregoing and other objects are attained will be further shown in the following detailed description and drawings, in which.

DETAILED DESCRIPTION

Figure 1:
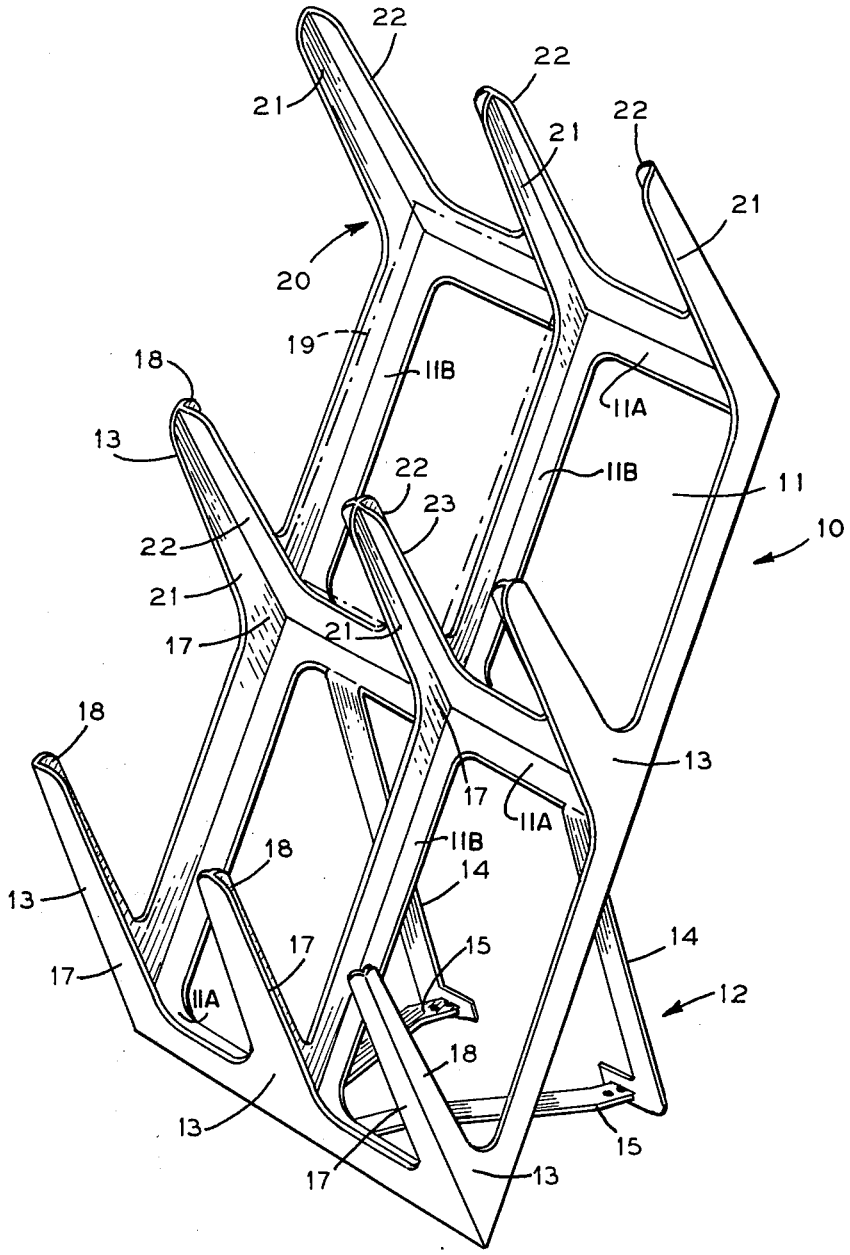
FIG. 1 is front perspective view of a display easel.

In FIG. 1 there is shown a front perspective view of the easel 10. The easel 10 comprises a rear panel 11 defined by a plurality of transversely and longitudinally extending ribs 11A and 11B, means of support 12 and parts of projectng brackets 13. The means of support 12 in this embodiment comprise a leg 14 and a base 15 which have hooks 16 at their end which lock together.

The lower brackets 13 are composed of a base 17 and a side wall 18 opposing the side wall 8 of the other bracket 13 of the pair. As shown in the middle brackets 13 the side wall 18 of one bracket 13 can double as the opposing side wall 18 for a different pair of brackets 13. A container 19 is then placed between the side walls 18 and is rested on the base 17 of the brackets 13. Any number of containers 19 can be placed between the side walls 18, the number only depending upon the length of the brackets 13.

There can also be placed on the rear panel 11 pairs of top brackets 20. The top brackets 20 are optional. The top brackets 20 are comprised of a top wall 22 and a side wall 21 opposing the side wall 21 of the opposing top bracket 20 of the pair of brackets 13. Again the side walls 21 and middle top brackets 20 can double as the opposing side walls 21 of a top bracket 20 of a different pair of top brackets 20. In this instance the base 17 of the bracket 13 can double as the top wall 22 of the top bracket 20.

How the side walls 18, 21 double and how the top wall 22 doubles as a base 17 is best shown in the middle most bracket 23.

In the figures there are shown four pairs of brackets 13 and four pairs of top brackets 20 to define a plurality of compartively in open communication with one another. However, the invention is not limited to four pairs nor is it limited to any specific number of pairs of brackets.

Figure 2:
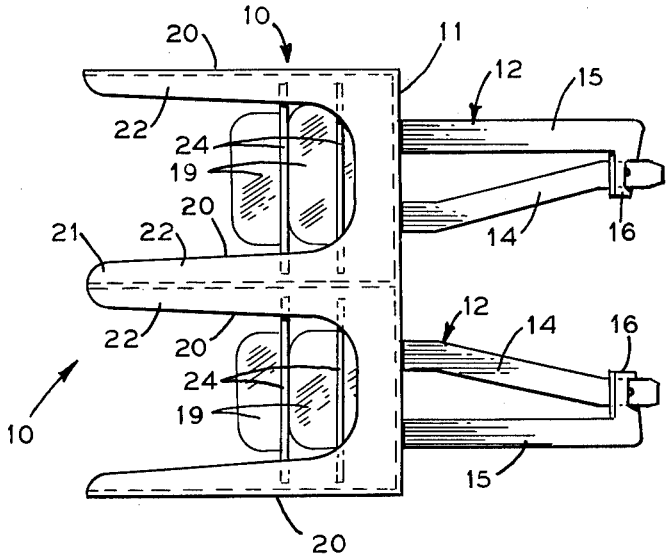
FIG. 2 is a top plan view thereof, with the legs extended.

FIG. 2 shows a top view of the easel 10. There is shown the top wall 22 of the top brackets 20. There is also shown the means of support 12 which comprise a let 14 and a base 15. The legs 14 and the base 15 have hooks 16 which interlock to support the rear panel 11.

Figure 3:
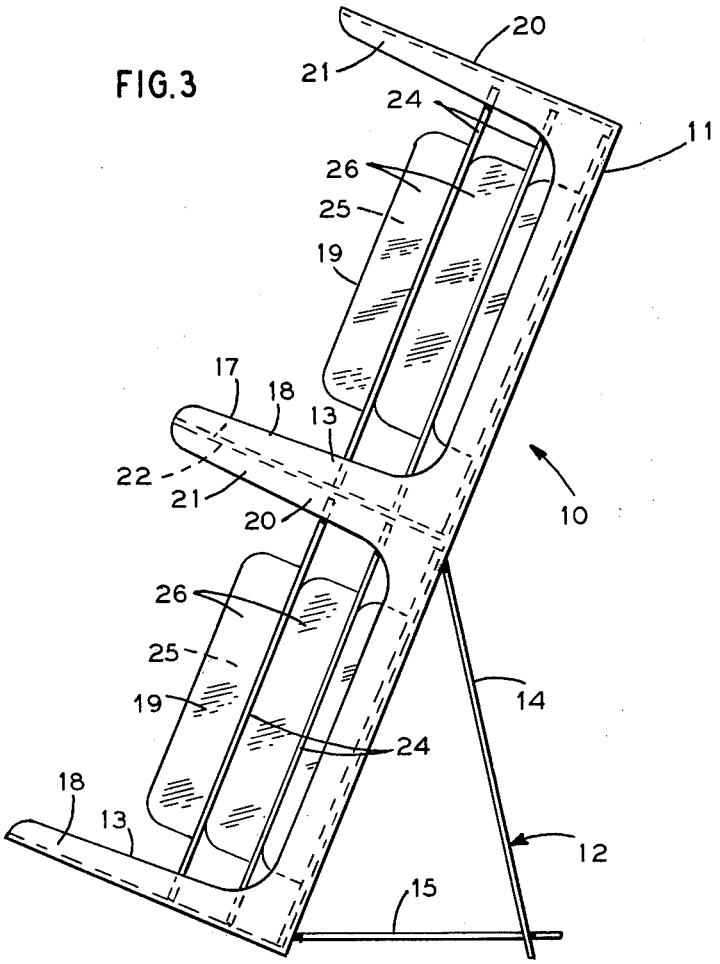
FIG. 3 is a side elevational view thereof showing the easel legs extended.

FIG. 3 shows a side view of the easel 10. Containers 19 have been placed in the brackets 13 and top brackets 20. The containers 19 have carboard backs 24 with the articles 25 between the cardboard backs 24 and plastic coverings 26.

I claim:

1. A display rack which can be readily erected between a collapsed and erected position comprising:

a plurality of transversely and longitudinally extending ribs to define a back panel, support means including a pair of spaced apart leg members hingedly connected to a transversely extending rib, whereby said leg members can be folded between a collapsed and erected position, complementary base member hingedly connected to a transversely extending rib spaced from said first mentioned transversely extending rib, said base member being readily folded between an erected and collapsed position, said leg members and base member having complementary interlocking means for locking said members in the erected position, and a plurality of brackets connected to said longitudinal and transversely extending ribs so as to project normal thereto, said brackets being disposed at the points of intersection of said longitudinally and transversely extending ribs, said brackets including angularly disposed side walls, whereby the complementary sides of opposed brackets define a support adapted for holding therebetween a plurality of articles to be displayed, said brackets including opposed corner brackets having the side walls thereof disposed at substantially right angles, and intermediate brackets disposed between said corner brackets, said intermediate brackets having a side wall which is common to the complementary side walls of said corner brackets, said side walls of the brackets being arranged so that the compartments defined thereby are in open communication with one another.

* * * * *